US012601131B1

(12) United States Patent
Hicks

(10) Patent No.: US 12,601,131 B1
(45) Date of Patent: Apr. 14, 2026

(54) WAVE DEFLECTOR APPARATUS

(71) Applicant: Woodrow Hicks, Bremen, AL (US)

(72) Inventor: Woodrow Hicks, Bremen, AL (US)

( * ) Notice: Subject to any disclaimer, the term of this patent is extended or adjusted under 35 U.S.C. 154(b) by 485 days.

(21) Appl. No.: 18/219,152

(22) Filed: Jul. 7, 2023

(51) Int. Cl.
*E02B 3/06* (2006.01)

(52) U.S. Cl.
CPC ..... *E02B 3/062* (2013.01)

(58) Field of Classification Search
CPC ..... E02B 3/06; E02B 3/062; E02B 3/064
See application file for complete search history.

(56) References Cited

U.S. PATENT DOCUMENTS 1,151,445 A * 8/1915 Dean ..... E02B 3/04 405/28
3,933,111 A * 1/1976 von Bose ..... E02B 3/26 405/212
4,693,631 A * 9/1987 Mckay ..... E02B 3/062 405/21
4,740,108 A * 4/1988 Levee ..... E02B 3/068 405/196
5,107,784 A 4/1992 Lacy
5,429,452 A 7/1995 Frost
5,702,203 A * 12/1997 Resio ..... E02B 3/062 405/26
6,652,193 B2 * 11/2003 Matsuura ..... E02B 3/062 405/195.1
7,390,141 B2 6/2008 Ryland
7,575,396 B2 8/2009 Cederlund
7,845,300 B1 12/2010 Stroud
11,255,061 B1 * 2/2022 Lopez ..... E02B 3/06
2001/0055516 A1 * 12/2001 King ..... E02B 3/06 405/32
2005/0058509 A1 * 3/2005 Steinberg ..... E02B 3/064 405/28

(Continued)

FOREIGN PATENT DOCUMENTS

CN 105714734 6/2016
CN 205617310 10/2016

(Continued)

OTHER PUBLICATIONS

Magic Float, Floating dock and Floating anti-wave barrier, https_ magicfloat.com.

(Continued)

*Primary Examiner* — Frederick L Lagman
(74) *Attorney, Agent, or Firm* — Lanier Ford Shaver & Payne, P.C.; Gerald M. Walsh

(57) ABSTRACT

A V-shaped wave deflector apparatus for protecting a floating dock or other structure from incoming waves of water created by wind or a watercraft is disclosed herein, in various aspects. The wave deflector has a first beam and a second beam, each having a mounting beam connected thereto, near a first end of the mounting beam. A second end of the mounting beam is attached rotatably to beam clamps which attach to the dock float beneath the floating dock. Wave deflector panels are attached to the first beam and to the second beam and redirect waves to the left and right of the floating dock, thereby reducing wave action against the floating dock. The mounting beams are rotatable, and the wave deflector apparatus may rotate downward beneath the floating dock, allowing access to a boat slip in the floating dock.

16 Claims, 12 Drawing Sheets

(56) References Cited

U.S. PATENT DOCUMENTS

| | | | | |
|---|---|---|---|---|
| 2013/0087089 | A1 | 4/2013 | Lill | |
| 2016/0053454 | A1* | 2/2016 | Neelamani | E02B 3/04 405/26 |
| 2023/0235521 | A1* | 7/2023 | Boonlikitcheva | E02B 3/062 405/26 |

FOREIGN PATENT DOCUMENTS

| | | | | | |
|---|---|---|---|---|---|
| CN | 109137820 | | | 1/2019 | |
| CN | 110080162 | A | * | 8/2019 | E02B 3/06 |
| CN | 111608133 | | | 8/2021 | |
| CN | 116002000 | | | 12/2022 | |
| CN | 117418506 | A | * | 1/2024 | E02B 3/06 |
| KR | 101731157 | | | 11/2014 | |
| WO | 1996031659 | | | 10/1996 | |

OTHER PUBLICATIONS

Reimagine Seaside Engineering, Wave Attenuator Systems, https_warnerparkbeach.weebly.com.

* cited by examiner

WAVE DEFLECTOR APPARATUS

FIELD OF THE DISCLOSURE

The present disclosure relates to wave attenuators for reducing or preventing wave action against a floating dock and related structures and, more particularly, to a wave deflecting system that deflects the waves away from the floating dock and absorbs the energy from the wave.

BACKGROUND OF THE DISCLOSURE

Floating docks typically comprise a deck placed on top of dock floats. The dock may be constructed to accommodate a boat slip. Floating docks are usually secured to the shore and anchored to the bottom of a body of water, such as a lake bottom. Anchoring the dock does not completely prevent the dock from moving up and down and side to side as waves move under the dock. Wave action can damage a dock and interfere with the use and enjoyment of the dock. Deep-water anchors may be impractical, requiring ongoing adjustments. Installation of anchors may be expensive, require licensed installation personnel, and my damage protected habitats.

U.S. Pat. No. 11,603,637 discloses a curtain draped on the front or sides of a floating dock to deflect waves downward. The curtain is secured to the side of a platform that is on the surface of a buoyant device. However, because the curtain is planar, wave action can still be transferred into the floating dock, limiting the effectiveness of the curtain. In addition, the curtain requires a winch arrangement on docks with a boat slip.

What is needed is a wave deflector for floating docks to deflect waves around the dock as well as downward and to absorb energy from the wave, thereby improving the suppression of the up and down and side to side motion of the dock resulting from wave action.

SUMMARY OF THE DISCLOSURE

The wave deflector apparatus for a floating dock, disclosed herein, attaches to a floating dock having a platform with a plurality of sides and at least one buoyant device for supporting the platform above the surface of the body of water. The wave deflector apparatus includes a first beam and a second beam constructed to form a V shape. The first beam and the second beam each having a mounting beam connected thereto near a first end of the mounting beam.

A second end of the mounting beam, opposite the first end of the mounting beam, is attached to a buoyant device on at least one side of a plurality of sides of the buoyant device. One or more wave deflector panels are attached to the first beam and to the second beam. The deflector panels are operable to redirect waves impacting the deflector panels to the to the left and right of the floating dock, thereby reducing wave action against the floating dock.

The second end of the mounting beam is attached rotatably to beam clamps and the beam clamps are attached to the buoyant device. The first end of the mounting beam is connected slidably to a mounting beam extension at a first end of the mounting beam extension and a second end of the mounting beam extension is attached to the beam. An energy absorbing member is mounted in an interior of the mounting beam and the energy absorbing member is compressed in the presence of wave action and uncompressed in the absence of wave action.

The beam clamps are attached to the buoyant device by attachment of the beam clamps to a pair of mounting bands and/or cables. The mounting bands and/or cables extend around the buoyant device and are attached at their ends to each other with tensioning pins. The wave deflector panels are attached to the first beam and the second beam with energy absorbing members wherein the energy absorbing members are compressed in the presence of wave action and uncompressed in the absence of wave action.

The mounting beam is rotatable on a hinge pin removably inserted through the beam clamps and the mounting beam. The mounting beam and the wave deflector apparatus are locked in a vertical position or in a horizontal position with a locking pin removably inserted through the beam clamps and the mounting beam.

An advantage of the V-shaped wave deflector apparatus of this disclosure is a wave deflector that deflects waves to the left and right of a floating dock, thereby reducing wave action against the floating dock.

Another advantage is a wave deflector apparatus that mounts on to a dock float below the decking of the floating dock.

Another advantage is a wave deflector apparatus that does not need to extend deep below the surface of the water.

Another advantage is a wave deflector apparatus that can rotate down into the water to allow watercraft to enter and leave a boat slip in the dock.

Another advantage is a wave deflector apparatus that can use energy absorbing devices, such as springs or shock absorbers to absorb the energy of waves and reduce their impact on the floating dock.

DETAILED DESCRIPTION OF THE DISCLOSURE

Figure 1:
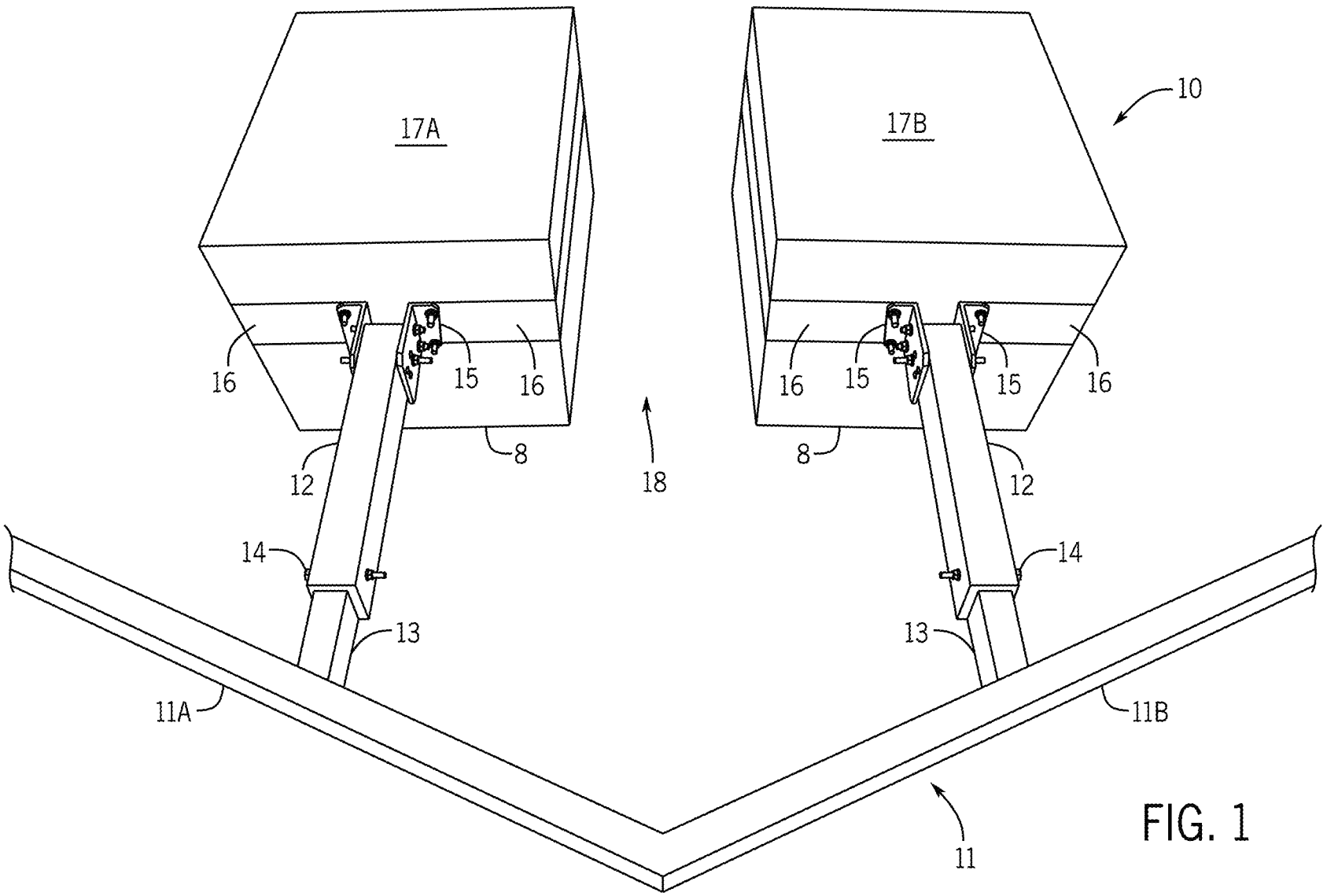
FIG. 1 shows a top, front view of the V-shaped wave deflector apparatus of this disclosure.

FIG. 1 shows a top, front 8 view of the wave deflector apparatus 10 of this disclosure. The front of apparatus 10 has a wave deflecting V-shaped beam 11 comprised of a first wave deflecting beam 11A and a second wave-deflecting beam 11B. Mounting beams 12 extend from the first beam 11A and the second beam 11B. The mounting beams 12 may be attached directly to the beams 11A and 11B at a first end of the mounting beams 12 or the beams 11A and 11B may each have mounting beam extensions 13 extending therefrom and inserted into an interior of the mounting beams 12 at a first end of the mounting beams 12. The mounting beam extensions 13 may be removably attached to the mounting beams 12 with a locking pin 14 inserted removably through the mounting beams 12 and the mounting beam extensions 13 near the first end of the mounting beam 12. A pair of beam clamps 15 are attached at a second end opposite the first end of the mounting beams 12. The beam clamps 15 on each mounting beam 12 are attached to the mounting beam 12 and to a pair of mounting bands 16. Each pair of mounting bands 16 wrap around a dock float so that beam 11A is connected to dock float 17A and beam 11B is connected to dock float 17B. The dock floats 17A and 17B may support a single deck platform (not shown) on top of dock floats 17A and 17B. The space between dock float 17A and dock float 17B is a boat slip 18 which may be formed in the single deck platform. The beam clamps 15 have a plurality of holes for attaching the beam clamps 15 to the mounting beams 12 and to the mounting bands 16.

Figure 2:
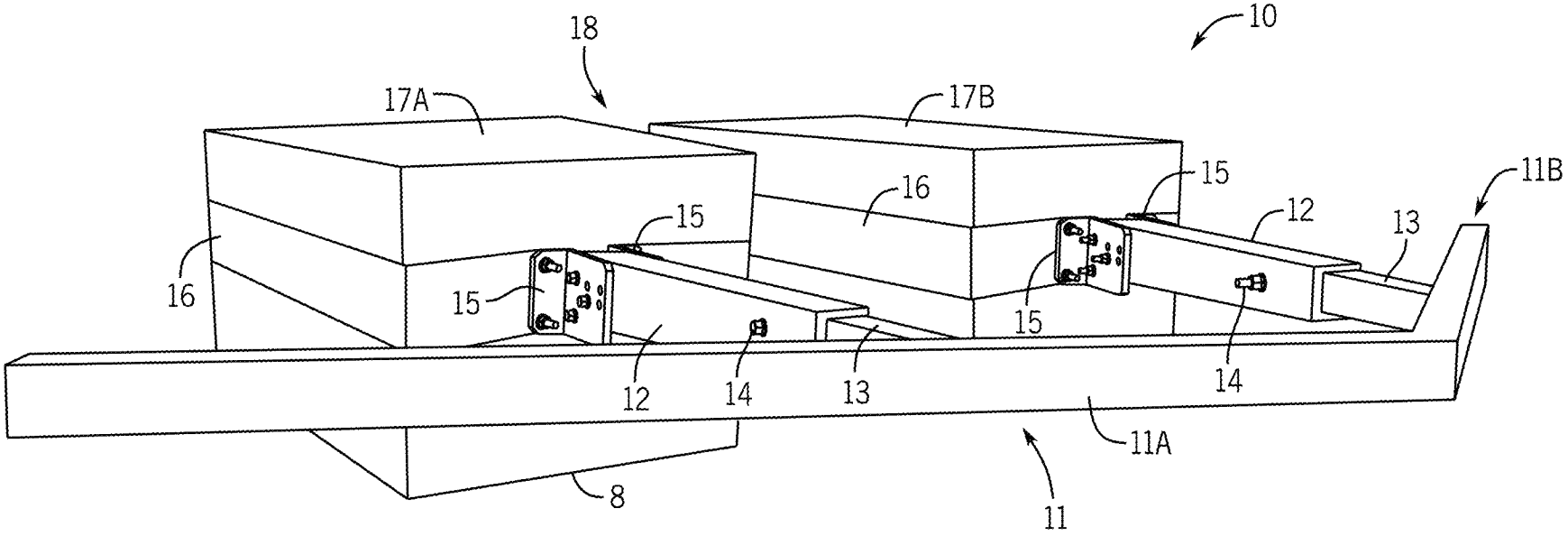
FIG. 2 shows a front, left side view of the V-shaped wave deflector apparatus.
Figure 3:
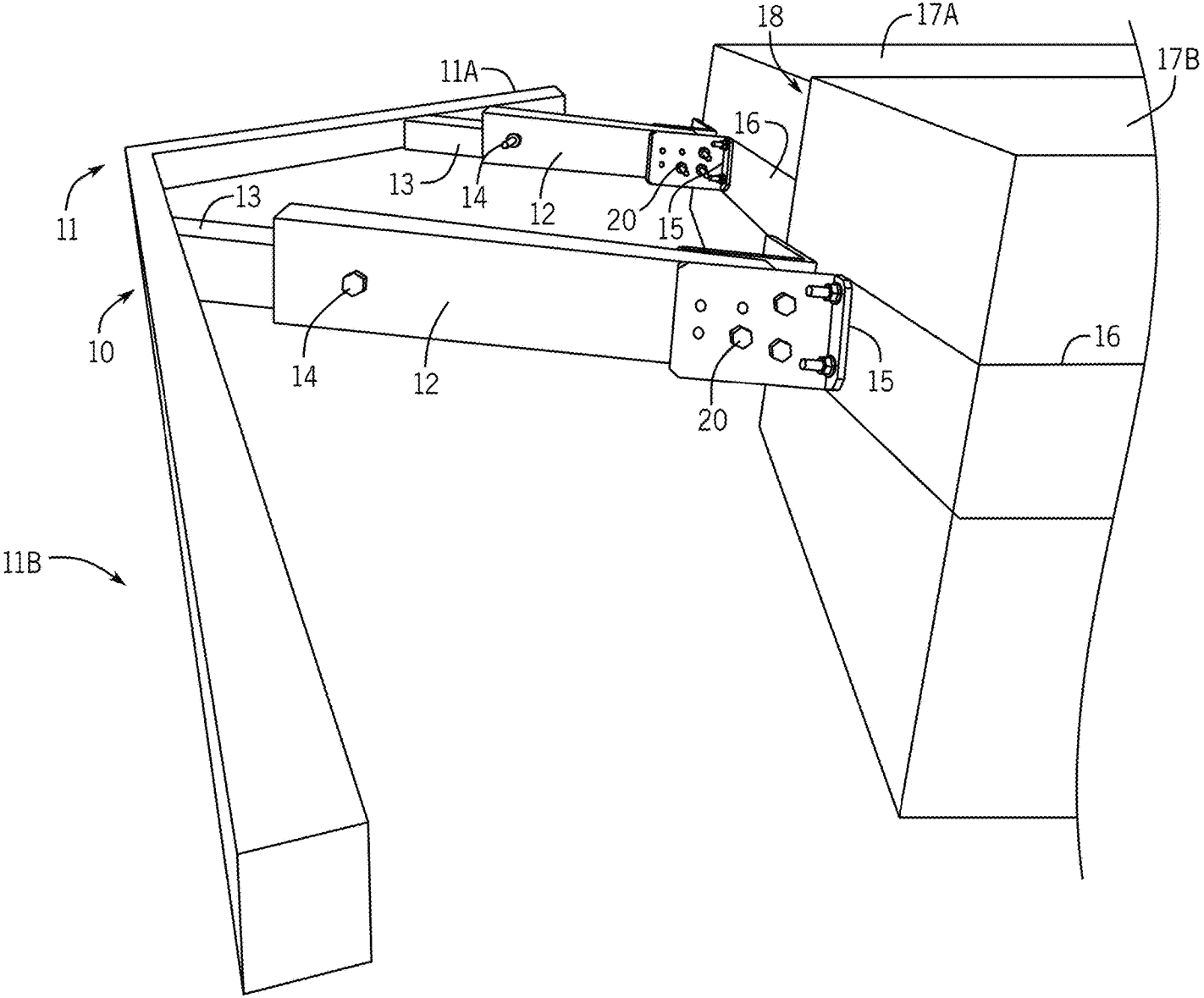
FIG. 3 shows a right-side view of the V-shaped wave deflector apparatus.
Figure 4:
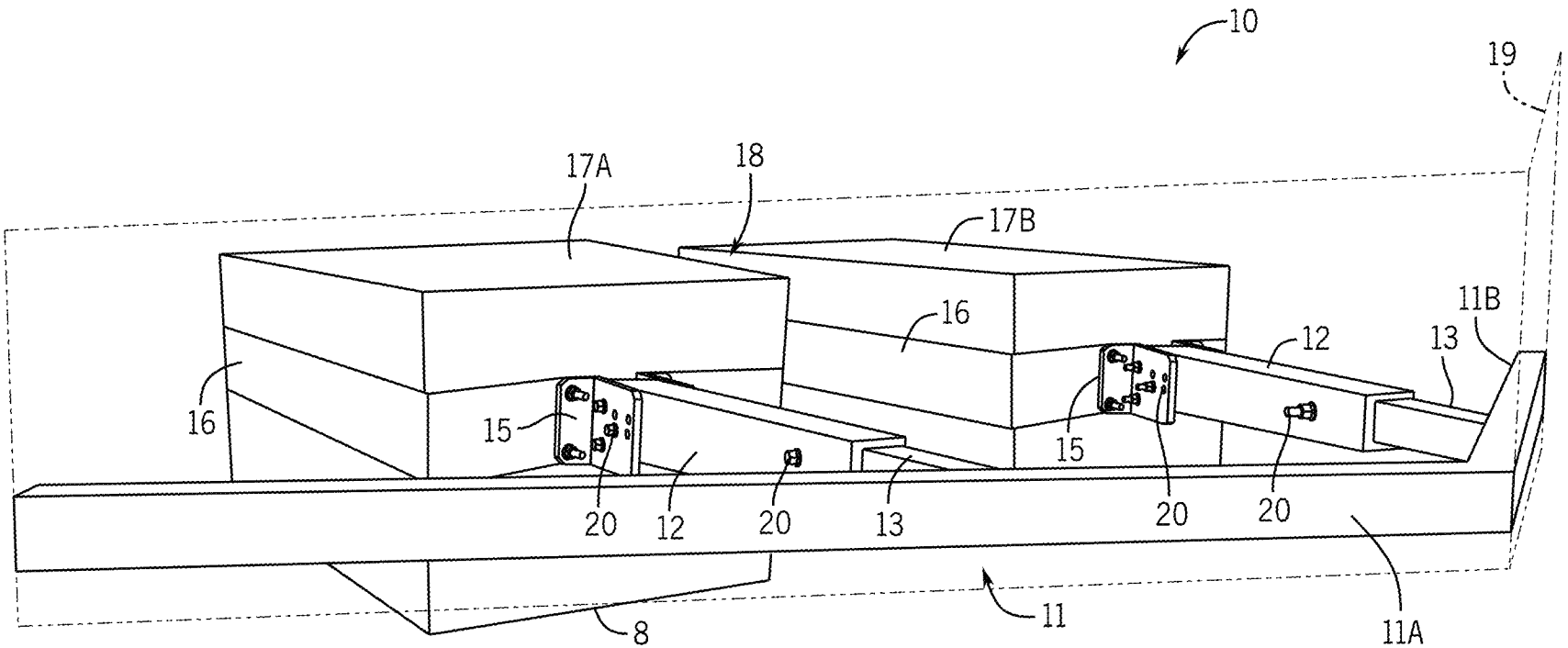
FIG. 4 shows a front, left side view of the V-shaped wave deflector apparatus.

FIG. 2 shows a front, left side view of the wave deflector apparatus 10. FIG. 3 shows a right-side view of the wave deflector apparatus 10, further showing a hinge pin 20 in the beam clamps 15 and the mounting beams 12. FIG. 4 shows a front, left side view of the wave deflector apparatus 10, further showing wave deflector panels 19 attached to the front of the V-shaped beam 11.

Figure 5:
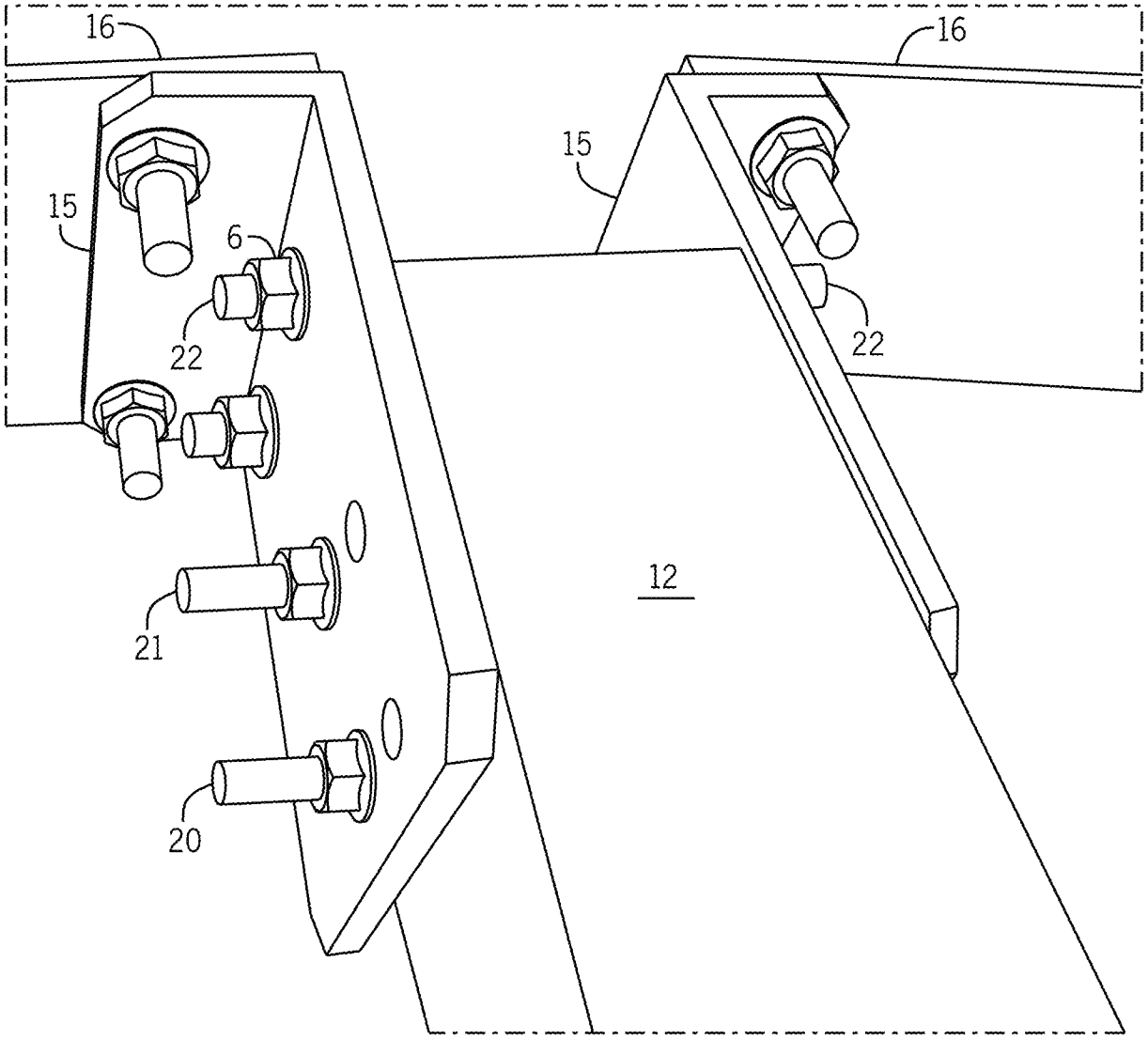
FIG. 5 shows an enlarged view of beam clamps attached removably and rotatably to a mounting beam for attaching the wave deflector apparatus to a side of the buoyant device.
Figure 6:
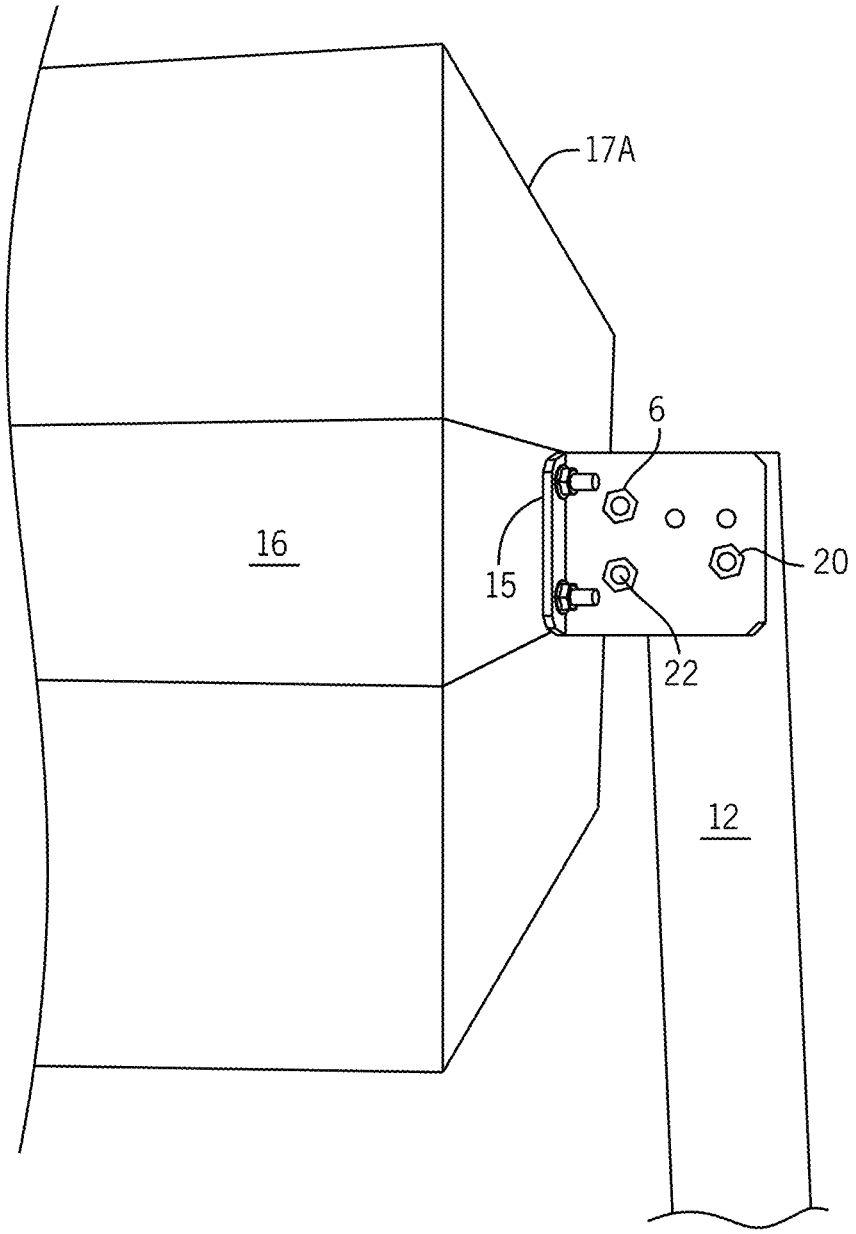
FIG. 6 shows a left side view of the beam clamps and the mounting beam.

FIG. 5 shows an enlarged view of the beam clamps 15. The beam clamps 15 are attached removably and rotatably to the mounting beam 12 at the second end of the mounting beam 12 with a hinge pin 20. The hinge pin 20 passes removably through the holes in the beam clamp 15 and through corresponding holes (not shown) in the mounting beam 12, allowing the mounting beam 12 to rotate from a vertical to a horizontal position. Other holes in the beam clamps 15 and corresponding holes (not shown) in the mounting beam 12 allow the insertion of a locking pin 21 to extend through the beam clamps 15 and the mounting beam 12 to lock the mounting beam 12 in a horizontal or vertical position. Threaded tension pins 22 pass through the beam clamp 15 to tighten the beam clamps together using nuts 6. FIG. 6 shows a left side view of the beam clamps 15 and the mounting beam 12 wherein the locking pin 21 is removed from the mounting beam 12 and the mounting beam 12 is rotated from a horizontal to a vertical position.

Figure 7:
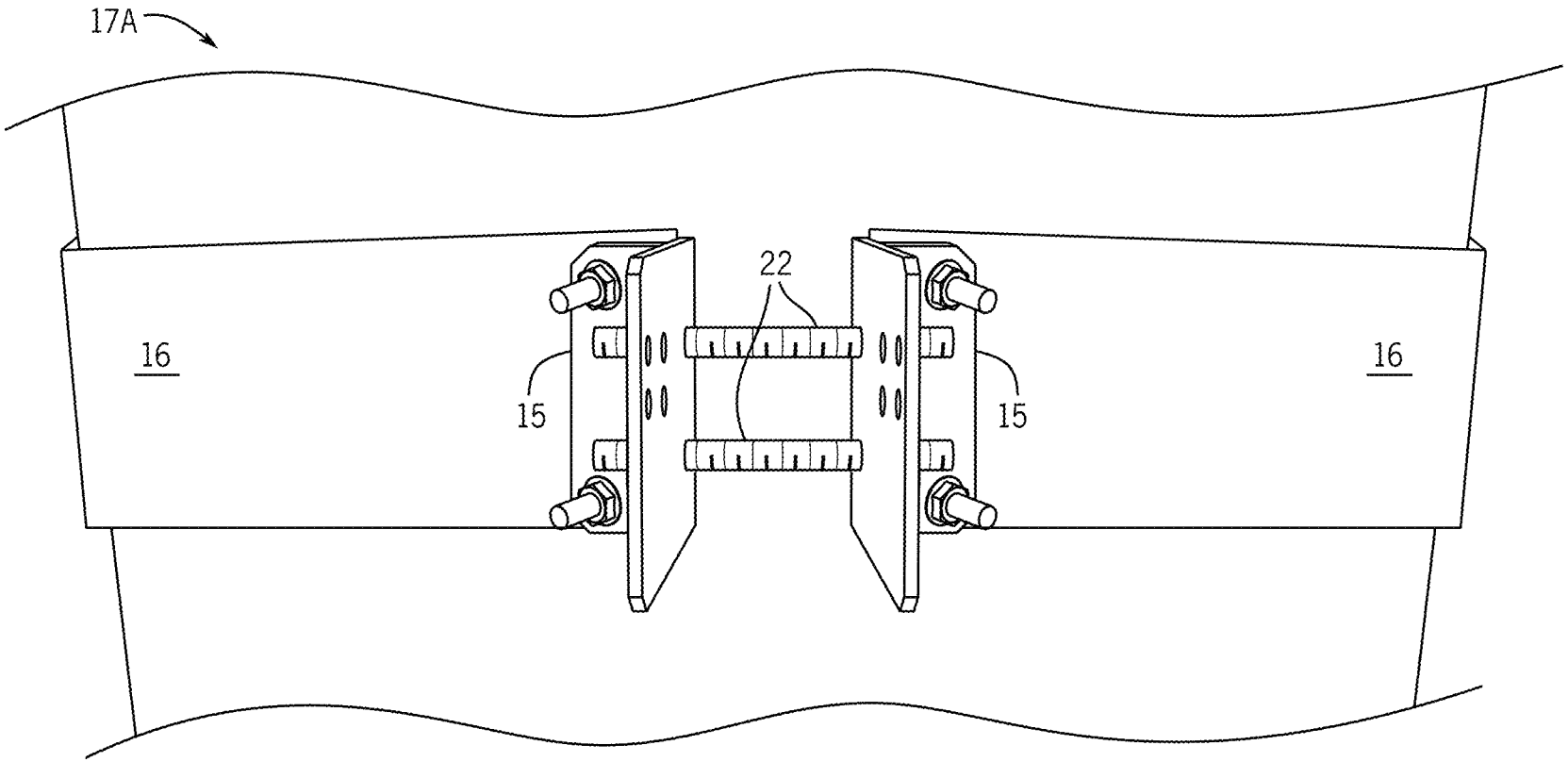
FIG. 7 shows a front view of the of the beam clamps with the mounting beam removed to reveal threaded tension pins that pull the beam clamps together.

FIG. 7 shows a front view of the of the beam clamps 15 with the mounting beam 12 removed to reveal the threaded tension pins 22 that pull the beam clamps 15 together when nuts 6 on the threaded tension pin 22 are tightened, thereby tightening the mounting bands 16 around the dock floats 17A and 17B.

Figure 8:
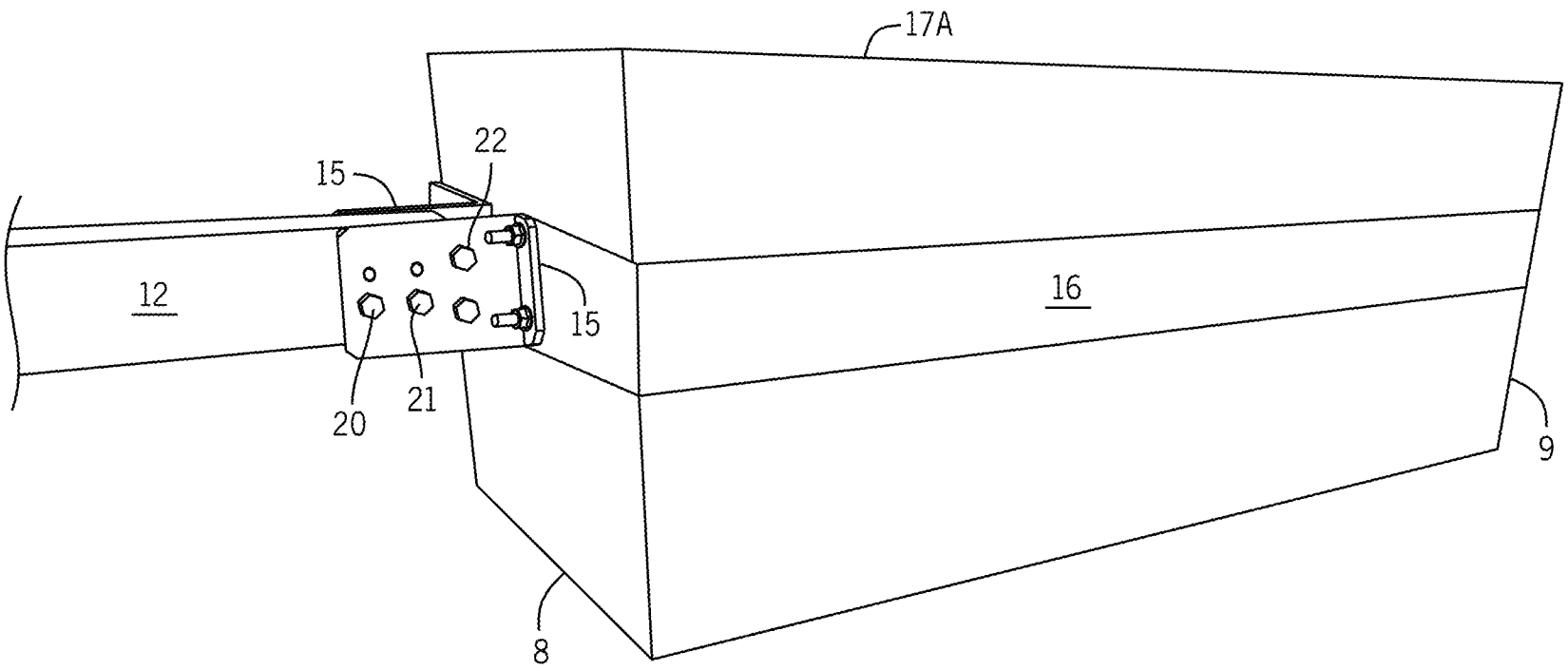
FIG. 8 shows a right-side view of the dock float with a mounting band extending around the dock float.

FIG. 8 shows a right-side view of the dock float 17A or 17B. A First mounting band 16 extends around the right side, around part of the front 8, and around part of the rear 9 of the dock float 17A or 17B. A first end of the mounting band 16 attaches to a beam clamp 15 at the front end 8 of the dock float and a second end opposite the first end of the mounting band 16 is positioned at the rear end 9 of the dock float 17A. A second mounting band 16 extends around the left side, around part of the front 8, and around part of the rear 9 of the dock float 17A. First ends of the mounting bands 16 attach to a beam clamp 15 at the front end 8 of the dock float and second ends opposite the first ends of the mounting bands 16 are positioned at the rear end 9 of the dock float.

Figure 9:
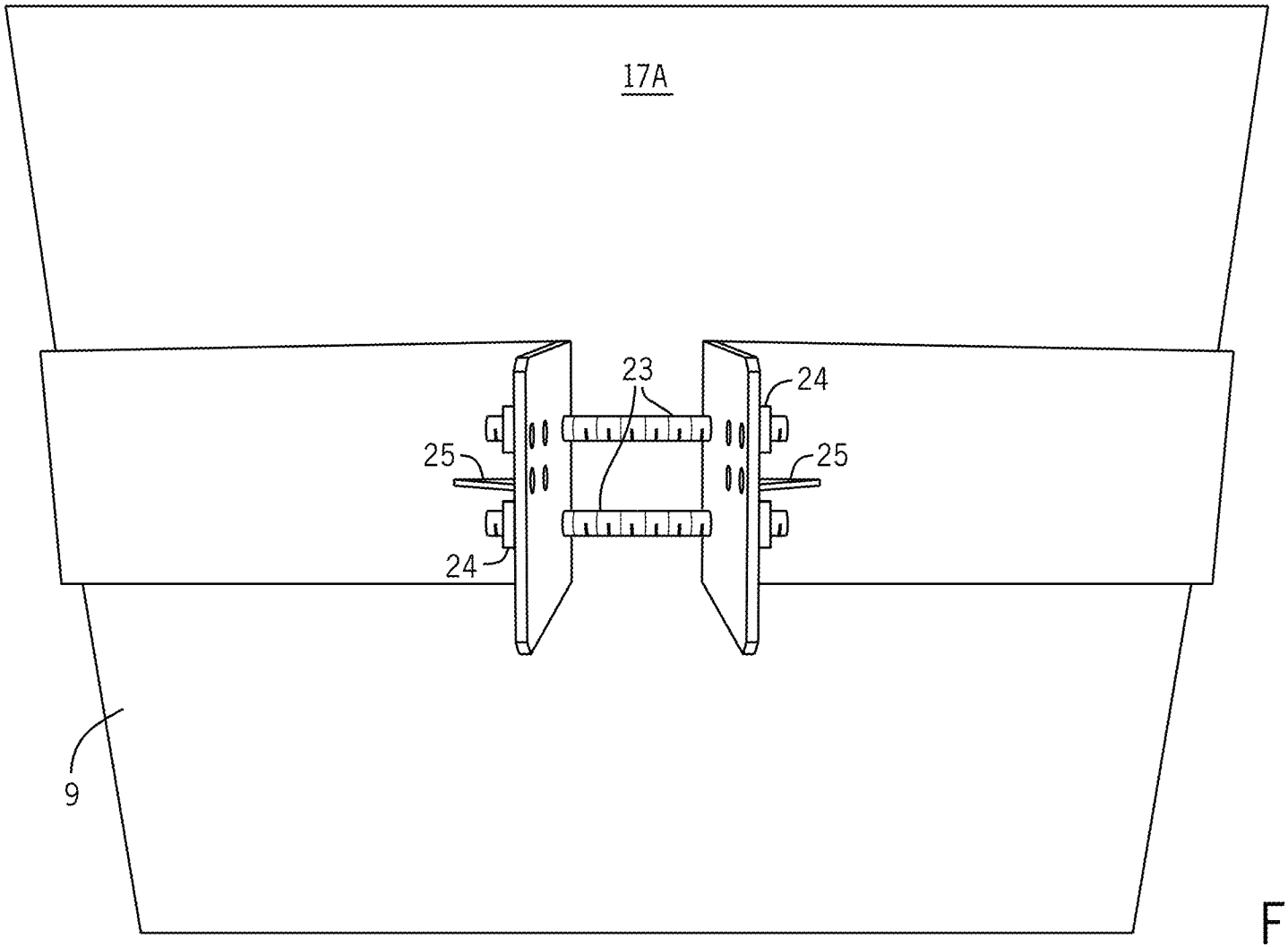
FIG. 9 shows the second ends of mounting bands attached to each other with threaded tensioning pins.

FIG. 9 shows the second ends of the mounting bands 16 attached to each other with threaded tensioning pins 23 using nuts 24 that are used to tighten the mounting bands 16 together at the back end 9 of the dock float. The second ends of the mounting bands 16 are reinforced with bracing members 25 to prevent the second ends from bending when they are drawn together with the threaded tensioning pins 27.

Figure 10:
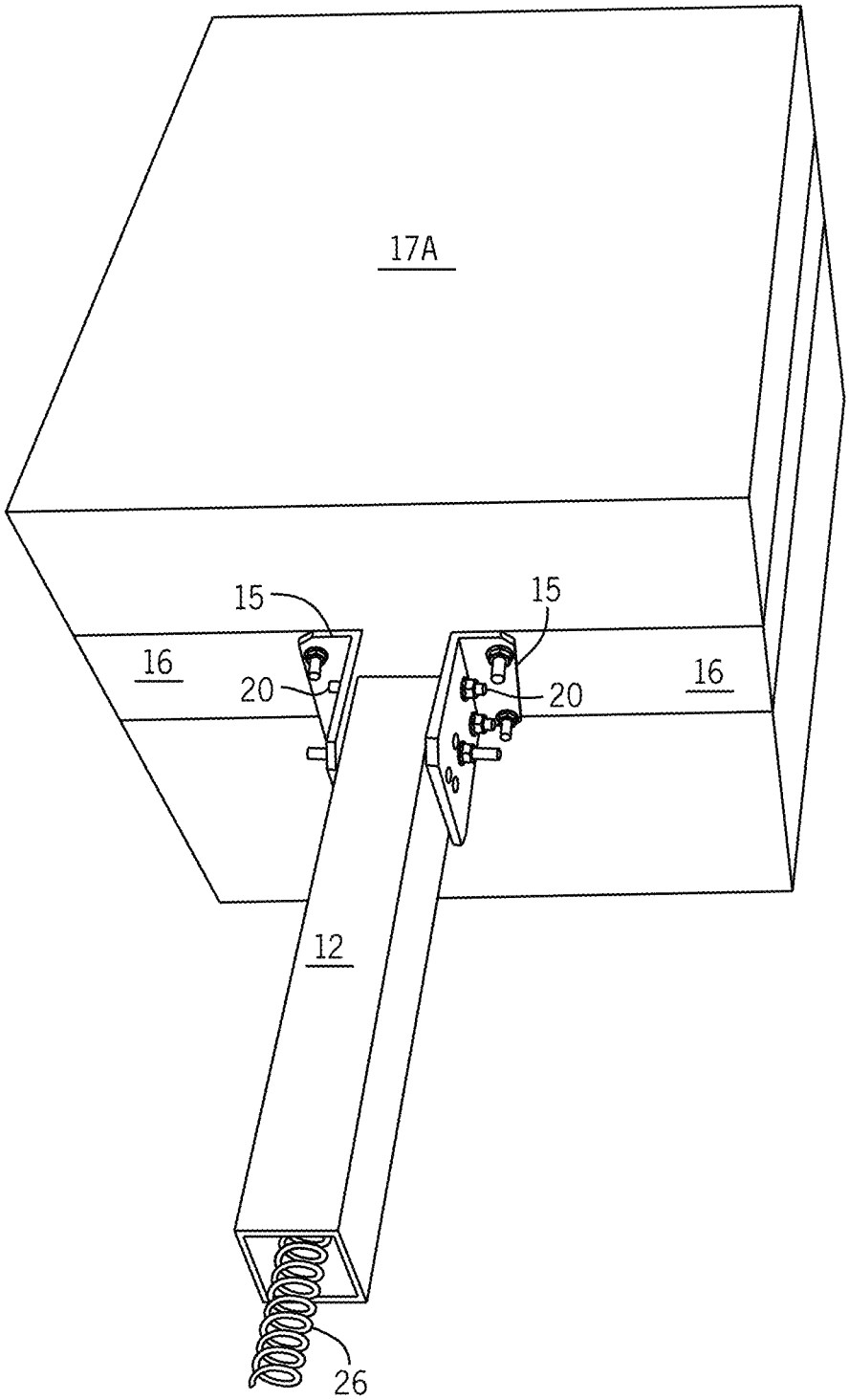
FIG. 10 shows the front end of a mounting beam having a shock absorbing member in an interior of the mounting beam.
Figure 11:
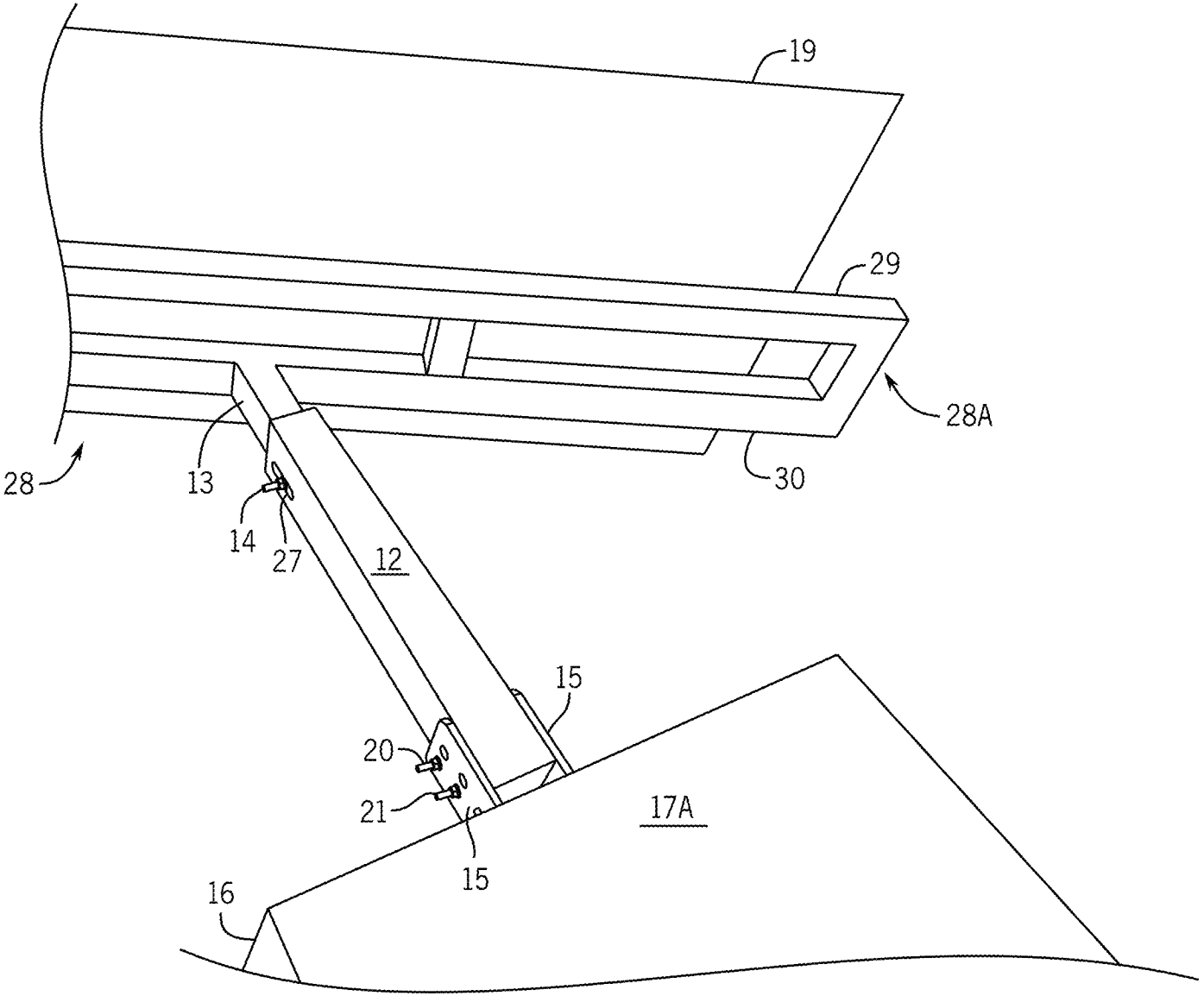
FIG. 11 shows a V-shaped double beam formed from a first double beam and a second double beam.

FIG. 10 shows a front end (first end) of the mounting beam 12 having a shock absorbing member, for example a spring 26, in an interior of the mounting beam 12. FIG. 11 shows a top view of the mounting beam 12 and a mounting beam extension 13 inserted into the interior of the mounting beam 12. The shock absorbing spring 26 shown in FIG. 10 is mounted in the mounting beam 12. A locking pin 14 is removably inserted through an oblong opening 27 in the mounting beam 12 and removably locks into an opening (not shown) in the mounting beam extension 13, thereby locking the mounting beam extension 13 slidably in the mounting beam 12. Because of the oblong opening 27 in the mounting beam 12, the mounting beam extension 13 is free to move inward into the interior of the mounting beam 12 in response to a wave pushing on the wave deflecting panels 19. As the mounting beam extension 13 moves inward into the interior of the mounting beam 12, the mounting beam extension 13 compresses the spring 26 in the interior of the mounting beam 12, thereby absorbing some of the force of the wave. As the wave dissipates, the spring 26 pushes the mounting beam extension 13 outward from the interior of the mounting beam 12. The distance the mounting beam extension 12 can move in and out of the interior of the mounting beam 12 is dependent upon the length of the oblong opening 27.

FIG. 11 shows the use of a V-shaped double beam 28. The double V-shaped beam 28 is formed from a first double beam 28A and a second double beam 28B (see FIG. 12), each of which together form a top V-shaped beam 29 and a bottom V-shaped beam 30. A wave deflector panel 19 is shown is shown attached to the first double beam 28A.

Figure 12:
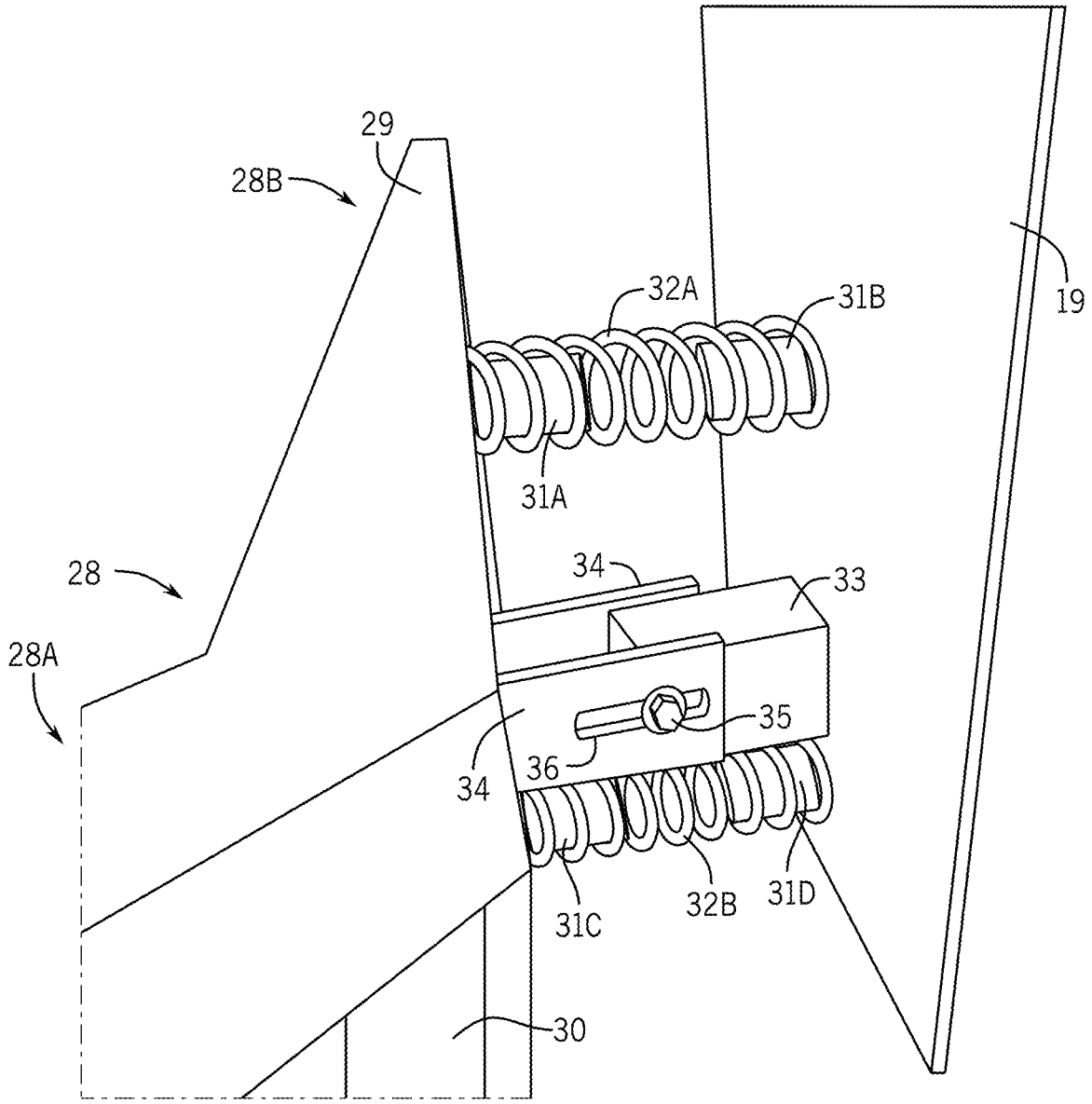
FIG. 12 shows a left front view of a second double beam of a V-shaped double beam having a wave deflector panel attached with energy absorbing members to the front of the second double beam.

FIG. 12 shows a left front view of the V-shaped double beam 28 having a wave deflector panel 19 attached to the front of the second double beam 28B. A spring mount 31A is attached to the front of the second double beam 28B on the top beam 29 and a spring mount 31B is attached to the wave deflection panel 19. A spring mount 31C is attached to the front of the second double beam 28B on the bottom beam 30 and a spring mount 31D is attached to the wave deflection panel 19. The spring mounts 31A and 31B are positioned inside a shock absorbing spring 32A and the spring mounts 31C and 31D are positioned inside a shock absorbing spring 32B. A first end of spring 32A is connected to the front of the second double beam 28B on the top beam 29 and a second end of spring 32A, opposite the first end of the spring 32A, is connected to the wave deflector panel 19. A first end of spring 32B is connected to the front of the second double beam 28B on the bottom beam 30 and a second end of spring 32B, opposite the first end of the spring 32B, is connected to the wave deflector panel 19. The spring mounts 32A-B in spring 32A and the spring mounts 32C-D in spring 32B are spaced apart so that the force of a wave pushing on the wave deflector panel 19 will compress the springs 32A and 32B, absorbing some of the energy of the wave. The force of a wave pushing on the wave deflector panel 19 will also compress the springs 26 in the mounting beams 12, further absorbing some of the energy of the wave. The wave deflector panel 19 is further stabilized by a guide member 33 which is slidably retained by guide plates 34, with a locking pin 35 inserted through an elongated opening 36 in the guide plates 34 and inserted through holes (not shown) in the guide member 36.

The structural features of the apparatus described herein for dock float 17A are the same for the apparatus for dock float 17B. Although this disclosure shows and describes beams 11A and 11B attached to the fronts of float docks 17A and 17B, the apparatus of float docks 17A or 17B can be attached to the sides of the dock floats. As waves of water approach the front of the floating docks the wave deflector panels 19 on V-shaped beam 11 will deflect the wave motion to the left and right of the docks, away from the sides of the dock, substantially reducing unwanted turbulence around the docks. Wave deflector panels on the sides of the docks will further reduce or eliminate unwanted turbulence around the docks. When the locking pins 21 are removed from the beam clamps 15, the mounting beams 12 rotate downward into the water so that a watercraft can leave and enter the boat slip 18. The beams 12, 13, 14A, and 14B can be of any desirable length and can be made of iron, steel, or plastic or combinations thereof. The wave deflector panels can be of any desirable height and made of any suitable metal or plastic or a combination thereof.

Although the drawings show the wave attenuator apparatus disclosed herein attached to a dock float with a boat slip and two dock floats, the wave attenuator apparatus can be applied to a single dock float with no boat slip. The dock floats can be made of any suitable material, preferably a plastic shell, preferably made of a high-density polyethylene or polyvinyl chloride (PVC) shell filled with air for buoyancy and, if desired, expanded polystyrene for additional rigidity.

The foregoing description illustrates and describes the system and method of the disclosure. Additionally, the disclosure shows and describes only the preferred embodiments but as mentioned above, it is to be understood that the preferred embodiments are capable of being formed in various other combinations, modifications, and environments and are capable of changes or modifications within the scope of the invention concepts as expressed herein, commensurate with the above teachings and/or the skill or knowledge of the relevant art. The embodiments described herein above are further intended to explain the best modes known by applicant and to enable others skilled in the art to utilize the disclosure in such, or other, embodiments and with the various modifications required by the particular application or uses thereof. Accordingly, the description is not intended to limit the invention to the form disclosed herein. Also, it is intended that the appended claims be construed to include alternative embodiments. It will be further understood that various changes in the details, materials, and arrangements of the parts which have been described and illustrated above to explain the nature of this invention may be made by those skilled in the art without departing from the principle and scope of the invention as recited in the following claims.

What is claimed is:

1. A wave deflector apparatus for a floating dock, the floating dock having a platform with a plurality of sides and at least one buoyant device for supporting the platform above the surface of the body of water, the wave deflector apparatus comprising:

a) a first beam and a second beam constructed to form a V shape;

b) the first beam and the second beam each having a mounting beam connected thereto near a first end of the mounting beam;

c) a second end of the mounting beam opposite the first end of the mounting beam is attached to beam clamps configured for attachment to the at least one buoyant device; an d) one or more wave deflector panels attached to the first beam and to the second beam, wherein the one or more deflector panels are operable to redirect waves, impacting the one or more deflector panels to the to the left and right of the floating dock, thereby reducing wave action against the floating dock.

2. The wave deflector apparatus of claim 1, wherein the second end of the mounting beam is attached rotatably to beam clamps or cables configured for attachment to the at least one buoyant device.

3. The wave deflector apparatus of claim 1, wherein the first end of the mounting beam is connected slidably to a mounting beam extension at a first end of the mounting beam extension and the second end of the mounting beam extension, opposite the first end of the mounting beam extension, is attached to the beam, wherein an energy absorbing member is mounted in an interior of the mounting beam, and wherein the energy absorbing member is compressed in the presence of wave action and uncompressed in the absence of wave action.

4. The wave deflector apparatus of claim 1, wherein the beam clamps or cables are attached to a pair of mounting bands, the mounting bands configured for extending around the at least one buoyant device and for attachment at their ends to each other with tensioning pins.

5. The wave deflector apparatus of claim 1, wherein the wave deflector panels are attached to the first beam and the second beam with energy absorbing members wherein the energy absorbing members are compressed in the presence of wave action and uncompressed in the absence of wave action.

6. The wave deflector apparatus of claim 2, wherein the mounting beam is rotatable on a hinge pin removably inserted through the beam clamps or cables and the mounting beam, and wherein the mounting beam and the wave deflector apparatus are locked in a vertical position or in a horizontal position with a locking pin removably inserted through the beam clamps or cables and the mounting beam.

7. A wave deflector apparatus for a floating dock, the floating dock having a platform with a plurality of sides and at least one buoyant device for supporting the platform above the surface of the body of water, the wave deflector apparatus comprising:

a) a first beam and a second beam constructed to form a V shape;

b) the first beam and the second beam each having a mounting beam connected thereto near a first end of the mounting beam;

c) a second end of the mounting beam opposite the first end of the mounting beam is attached to the at least one buoyant device on at least one side of a plurality of sides of the at least one buoyant device; and d) one or more wave deflector panels attached to the first beam and to the second beam, wherein the one or more deflector panels are operable to redirect waves, impacting the one or more deflector panels to the to the left and right of the floating dock, thereby reducing wave action against the floating dock.

8. The wave deflector apparatus of claim 7 wherein the second end of the mounting beam is attached rotatably to beam clamps or cables and the beam clamps or cables are attached to the at least one buoyant device.

9. The wave deflector apparatus of claim 7 wherein the first end of the mounting beam is connected slidably to a mounting beam extension at a first end of the mounting beam extension and the second end of the mounting beam extension, opposite the first end of the mounting beam extension, is attached to the beam, wherein an energy absorbing member is mounted in an interior of the mounting beam, and wherein the energy absorbing member is compressed in the presence of wave action and uncompressed in the absence of wave action.

10. The wave deflector apparatus of claim 7, wherein the beam clamps or cables are attached to the at least one buoyant device by attachment of the beam clamps or cables to a pair of mounting bands, the mounting bands extending around the buoyant device and attached at their ends to each other with tensioning pins.

11. The wave deflector apparatus of claim 7, wherein the wave deflector panels are attached to the first beam and the second beam with energy absorbing members wherein the energy absorbing members are compressed in the presence of wave action and uncompressed in the absence of wave action.

12. The wave deflector apparatus of claim 8, wherein the mounting beam is rotatable on a hinge pin removably inserted through the beam clamps or cables and the mounting beam, and wherein the mounting beam and the wave deflector apparatus are locked in a vertical position or in a horizontal position with a locking pin removably inserted through the beam clamps or cables and the mounting beam.

13. A wave deflector apparatus for a floating dock, the floating dock having a platform with a plurality of sides and at least one buoyant device for supporting the platform above the surface of the body of water, the wave deflector apparatus comprising:

a) a first beam and a second beam constructed to form a V shape;

b) the first beam and the second beam each having a mounting beam connected thereto near a first end of the mounting beam;

c) a second end of the mounting beam opposite the first end of the mounting beam is attached to the at least one buoyant device on least one side of a plurality of sides of the at least one buoyant device; and d) one or more wave deflector panels attached to the first beam and to the second beam, wherein the one or more deflector panels are operable to redirect waves, impacting the one or more deflector panels to the to the left and right of the floating dock, thereby reducing wave action against the floating dock, wherein the second end of the mounting beam is attached rotatably to beam clamps or cables and the beam clamps or cables are attached to the at least one buoyant device, wherein the first end of the mounting beam is connected slidably to a mounting beam extension at a first end of the mounting beam extension and the second end of the mounting beam extension, opposite the first end of the mounting beam extension, is attached to the beam, wherein an energy absorbing member is mounted in an interior of the mounting beam, and wherein the energy absorbing member is compressed in the presence of wave action and uncompressed in the absence of wave action.

14. The wave deflector apparatus of claim 13, wherein the beam clamps or cables are attached to the at least one buoyant device by attachment of the beam clamps or cables to a pair of mounting bands, the mounting bands extending around the buoyant device and attached at their ends to each other with tensioning pins.

15. The wave deflector apparatus of claim 13, wherein the wave deflector panels are attached to the first beam and the second beam with energy absorbing members wherein the energy absorbing members are compressed in the presence of wave action and uncompressed in the absence of wave action.

16. The wave deflector apparatus of claim 13, wherein the mounting beam is rotatable on a hinge pin removably inserted through the beam clamps or cables and the mounting beam, and wherein the mounting beam and the wave deflector apparatus are locked in a vertical position or in a horizontal position with a locking pin removably inserted through the beam clamps or cables and the mounting beam.

* * * * *